US006785495B2

(12) United States Patent
Baker et al.

(10) Patent No.: US 6,785,495 B2
(45) Date of Patent: Aug. 31, 2004

(54) APPARATUS AND METHOD FOR REMOVING CARRIER LIQUID FROM AN INTERMEDIATE TRANSFER MEMBER SURFACE OR FROM A TONED IMAGE ON AN INTERMEDIATE TRANSFER MEMBER

(75) Inventors: James A. Baker, Hudson, WI (US); Gay L. Herman, Cottage Grove, MN (US); Charles W. Simpson, Lakeland, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/428,496

(22) Filed: May 2, 2003

(65) Prior Publication Data

US 2004/0052551 A1 Mar. 18, 2004

(30) Foreign Application Priority Data

Sep. 13, 2002 (KR) ..... 10-2002-0055636

(51) Int. Cl.[7] ..... G03G 15/10
(52) U.S. Cl. ..... 399/249
(58) Field of Search ..... 399/101, 249, 399/250, 251; 430/97

(56) References Cited

U.S. PATENT DOCUMENTS

| | | | | |
|---|---|---|---|---|
| 5,404,209 A | * | 4/1995 | Matsuoka et al. | 399/249 |
| 5,420,675 A | | 5/1995 | Thompson et al. | 355/256 |
| 5,552,869 A | | 9/1996 | Schilli et al. | 355/256 |
| 5,736,286 A | | 4/1998 | Kaneko et al. | 430/97 |
| 5,978,631 A | | 11/1999 | Lee | 399/251 |
| 6,047,151 A | | 4/2000 | Carvalho et al. | 399/250 |
| 6,101,356 A | | 8/2000 | Kim et al. | 399/250 |
| 6,205,312 B1 | | 3/2001 | Kim | 399/249 |
| 6,493,531 B2 | | 12/2002 | Choi | 399/251 |

FOREIGN PATENT DOCUMENTS

JP 2-230275 A * 9/1990

* cited by examiner

*Primary Examiner*—Hoan Tran
(74) *Attorney, Agent, or Firm*—Mark A. Litman & Associates, P.A.

(57) ABSTRACT

A liquid electrophotographic imaging apparatus contains at least one drying element for removing excess carrier liquid in a liquid toner toned latent image on an intermediate transfer member surface or from the intermediate transfer member surface itself. The drying sheet includes a flexible substrate having a first surface and second surface; at least one oleophilic carrier liquid absorptive layer on the first surface of the flexible substrate; and the first surface of the flexible substrate facing the intermediate transfer member surface, latent image or liquid toned latent image. A method of using this apparatus includes providing at least one absorbent drying sheet; providing an electrophotographic apparatus including at least an intermediate transfer member; at least one supply container and at least one discard container for the at least one absorbent drying sheet; providing a toned image on the intermediate transfer member with a liquid toner; contacting an absorbent drying sheet from the supply container to the toned image on the intermediate transfer member or to the intermediate transfer member itself after the image is transferred away; absorbing liquid carrier with the drying sheet, the drying sheet then becoming a used drying sheet; determining whether the used drying sheet is suitable for reuse as an absorbent drying sheet; and placing the used drying sheet in a container.

28 Claims, 5 Drawing Sheets

APPARATUS AND METHOD FOR REMOVING CARRIER LIQUID FROM AN INTERMEDIATE TRANSFER MEMBER SURFACE OR FROM A TONED IMAGE ON AN INTERMEDIATE TRANSFER MEMBER

BACKGROUND OF THE INVENTION

1. Field of the Invention

This invention relates to liquid electrophotography, especially an apparatus and method for removing carrier liquid from an intermediate transfer member surface or from a liquid developed toned image on an intermediate transfer member.

2. Background of the Art

Electrophotography forms the technical basis for various well known imaging processes, including photocopying and some forms of laser printing. The basic electrophotographic process involves placing a uniform electrostatic charge on a photoreceptor, imagewise exposing the photoreceptor to activating electromagnetic radiation (also referred to herein as "light" and including infrared, visible light and ultraviolet radiation) and thereby dissipating the charge in the exposed areas to form an electrostatic latent image, developing the resulting electrostatic latent image with a toner, and transferring the toner image from the photoreceptor to a final substrate, such as paper, either by direct transfer or via an intermediate transfer material. The direct or intermediate transfer typically occurs by one of two methods: electrostatic assist (electrostatic transfer) or elastomeric assist (adhesive transfer). "Adhesive transfer" means that transfer was primarily effected by surface tension phenomena (e.g., including tack) between the receptor surface and the temporary carrier surface or medium for the toner. "Electrostatic transfer" means that transfer was primarily effected by electrostatic charges or charge differential phenomena between the receptor surface and the temporary carrier surface or medium for the toner.

The effectiveness of adhesive transfer is controlled by several variables including surface energy, temperature, and pressure. Electrostatic transfer is also affected by surface energy, temperature, and pressure, but the primary driving force causing the toner image to be transferred to the final substrate is via electrostatic forces.

The structure of a photoreceptor generally may be a continuous belt, which is supported and circulated by rollers, or a rotatable drum. All photoreceptors have a photoconductive layer which transports charge (either by an electron transfer of charge transfer mechanism) when the photoconductive layer is exposed to activating electromagnetic radiation or light. The photoconductive layer is generally affixed to an electroconductive support. The surface of the photoreceptor is either negatively or positively charged such that when activating electromagnetic radiation strikes a region of the photoconductive layer, charge is conducted through the photoreceptor in that region to neutralize, dissipate or reduce the surface potential in the illuminated region. An optional barrier layer may be used over the photoconductive layer to protect the photoconductive layer and extend the service life of the photoconductive layer. Other layers, such as adhesive layers or priming layers or charge injection blocking layers are also used in some photoreceptors. A release layer may be used to facilitate transfer of the image from the photoreceptor to either the final substrate, such as paper, or to an intermediate transfer element.

Typically, a positively charged toner is attracted to those areas of the photoreceptor which retain a negative charge after the imagewise exposure, thereby forming a toner image which corresponds to the electrostatic latent image. The toner need not be positively charged, although that charge form or a neutral charge is preferable. Some toners (irrespective of their charge) may be attracted to the areas of the photoreceptor where the charge has been dissipated. The toner may be either a powdered material comprising a blend or association of polymer and colored particulates, typically carbon for a black image, or a liquid material of finely divided solids dispersed in an insulating liquid that is frequently referred to as a carrier liquid.

Generally, the carrier liquid is a hydrocarbon that has a low dielectric constant (e.g., less than 3) and a vapor pressure sufficiently high to ensure rapid evaporation of solvent following deposition of the toner onto a photoreceptor, transfer belt, and/or receptor sheet. Rapid evaporation is particularly important for cases in which multiple colors are sequentially deposited and/or transferred to form a single image. Examples of such carrier liquids include NORPAR™ and ISOPAR™ solvents from Exxon Chemical Company.

Liquid toners are often preferable because they are capable of giving higher resolution images and require lower energy for image fixing than do dry toners. However, excess carrier liquid which is transferred to the photoreceptor can create a variety of problems. When either the elastomeric or adhesive transfer mechanism is being used, removal of excess carrier liquid is especially important. The excess carrier liquid can blot or stain the image or can cause smudging or streaking of the images. In addition, if excess carrier liquid is not removed, additional energy will be required at the image fixing step to volatilize the excess carrier liquid. Also, removal of the excess carrier liquid generally leads to improved image clarity and image density.

A variety of methods have been employed to remove excess carrier liquid from a developed toner image. These methods include squeegee rolls, air knives, corona discharge, vacuum removal, and absorption.

U.S. Pat. No. 5,420,675 to Thompson et al. discloses the use of a film forming roller which has a thin, outer layer which is compatible (referred to as 'phillic') with the carrier liquid and an inner layer which is carrier liquid-phobic and compressible. The film forming roller of that patent is maintained in contact with a single heating roller. The carrier liquid entrained in the film forming roller is removed by heating the liquid to a temperature greater than or equal to the flashpoint of the liquid.

U.S. Pat. No. 5,552,869 to Schilli et al. discloses a drying method and apparatus for electrophotography using liquid inks. The drying apparatus removes excess carrier liquid from an image produced by liquid electrophotography on a moving organophotoreceptor. The system includes a drying roller that contacts the organophotoreceptor, with an outer layer that absorbs and desorbs the carrier liquid and an inner layer having a Shore A hardness of 10 to 60 which is carrier liquid-phobic, and a heating means to increase the temperature of the drying roller to no more than 5° C. below the flash point of the carrier liquid. In one embodiment, the heating means includes two hot rollers and the system further includes a cooling means that cool the drying roller.

U.S. Pat. No. 5,736,286 to Kaneko et al. discloses the employment of a drying belt to remove carrier fluids in liquid inks.

The art teaches drying of a liquid toned image by absorbing or "drying" processes consisting of absorbing the excess carrier fluid from the image face, after the image is plated onto the photoreceptor and before the image is transferred to the receiving medium, by means of an absorptive polymer layer coated onto a roller, belt, or disk. Other methods of carrier fluid removal include: drying the image from the backside of the image using vacuum assistance through a semi-permeable membrane; thermally drying the receiving medium after the image has been transferred, absorbing by the drying member, of excess carrier fluid from a non-absorptive intermediate transfer belt after the image has been transferred to the receiving medium; and thermally evaporating the excess carrier fluid from an absorptive transfer belt and/or the image into the surrounding environment.

In cases of continuous printing, the drying belt or roller may become substantially saturated with carrier liquid at some point. At this point, regeneration or "renewing" the drying member is desirable because absorption of carrier fluid by the drying member may be repeated after the carrier has been absorbed and the imaging cycle completed. Regeneration is usually facilitated by heat, pressure, or vacuum or a combination thereof. After regeneration is completed, the drying member is capable of absorbing more carrier fluid because the drying member remains unsaturated with the carrier fluid. The art teaches thermal regeneration of the drying member to prevent saturation; however, this use of a single belt or roller, which is subject to countless absorption and regeneration (or "desorption") cycles, has many associated problems.

For example, continual contact of a heated regeneration element with the drying belt or roller can cause the belt or roller to heat up, resulting in hot offset of the liquid toned image to the hot surface of the drying belt or roller.

Another problem is associated with the need for constant absorption and regeneration of the drying member. A heating element is frequently used to evaporate the unwanted carrier liquid in the drying roller or belt. This evaporation step creates carrier liquid vapor that may be harmful to consumers and may be regulated by environmental standards. The harmful vapor must therefore be collected or rendered harmless creating a need for a vapor collection system or apparatus in the imaging line (a complex and usually costly system typically comprising at least a fan, collection ducts, and a condenser). The evaporated and condensed carrier is then stored in liquid form in the printer until disposal.

Another problem that occurs in carrier removal is that the repetitive use and regeneration of the same drying or absorptive belt or roller degrades the absorbent layer, introducing artifacts/contaminants to the toner image, and generally decreasing the life of the drying roller or belt. The high heat necessary to continually evaporate a non-volatile or high flashpoint solvent from the absorbent layer also has the effect of degrading the surface of the belt or roller. Over time a continuously re-used belt or roller will pick up sufficient contaminants (e.g., paper fibers, dust, toner particles, etc.) to increase the surface energy. If the surface energy of the roller or belt increases, it will begin to adhere to surfaces that have a lower surface energy, like the photoreceptor, the intermediate transfer member, or even the toner. To keep contaminants from altering the surface energy of the roller or belt, a cleaning mechanism is frequently employed in an attempt to maintain integrity.

An irreversible problem associated with the drying rollers and belts of the prior art is when ozone from the corona in an electrophotographic printer oxidizes the surface of the roller or belt. Once ozone damage is done, there is no possibility for renewal.

The drying rollers of the prior art are expensive to make and difficult to exchange. They frequently have a metal core, adding to the cost of manufacture. Both belts and rollers are also consumable components of a printer that generally require a visit by a service person for exchange.

These and other problems associated with drying carrier liquid from an intermediate transfer member and/or drying carrier liquid from a liquid developed image on an intermediate transfer member are known to those skilled in the art. The art continually searches for solutions to these problems and improved drying methods.

SUMMARY OF THE INVENTION

This invention addresses problems associated with using a single absorbent roller, or absorbent belt to absorb excess carrier and a heating roll to remove the absorbed carrier so that the single absorbent roller or absorbent belt may be continually reused.

A first aspect of the invention is a liquid electrophotographic imaging apparatus containing at least one drying element for removing excess carrier liquid from a liquid toner toned latent image on an intermediate transfer member surface or the intermediate transfer member surface without the toner image. One element of an at least one drying sheet may be present as a flexible substrate having a first surface and second surface; another element is that there is at least one oleophilic carrier liquid absorptive layer on the first surface of the flexible substrate. The at least one drying sheet preferably should be distinct articles and is not a fixed layer or a fixed set of layers on a roller or belt. The at least one drying sheet preferably could be a series of single sheets, sheets on a roll with individual sheets defined by perforated separation lines, or a continuous sheet on a roll fed from one roll to another. Another element of the apparatus is that the first surface of the flexible substrate faces the intermediate transfer member surface, latent image or liquid toned latent image when it is placed in position to absorb liquid carrier. An alternative feature of the invention is that the first surface and said second surface both may have an oleophilic absorptive layer affixed to each of the first surface and the second surface. In one embodiment of the invention, the absorbent sheet may have an additional element of a compliant inner layer affixed between the flexible substrate and the at least one oleophilic carrier liquid absorptive layer. In a further embodiment of the invention, the inner layer may be oleophobic to carrier liquid. In a preferred embodiment, the inner layer comprises a polymer selected from nitrile elastomers, fluorosilicone polymers, fluorocarbon polymers, and polyurethane polymers.

In a preferred embodiment for the at least one absorbent layer, desirable materials include a polymer selected from the group consisting of silicone polymers, ethylene/propylene copolymers, polybutadienes, and polyisoprenes. The apparatus may provide sheet handling systems that move the drying sheet from a storage area or supply area to position the drying sheet into contact with a surface of an intermediate transfer member where the sheet will be able to contact carrier liquid for the purpose of drying liquid carrier. In a preferred embodiment, the absorbent layer of the sheet has a surface energy that is at least 1 dyne/cm less than the surface energy of the surface it is positioned to contact and to dry. In one feature, the imaging apparatus of this invention should provide a drying sheet that is capable of absorbing 2%–70% of its own weight in carrier liquid (e.g., 2–70% liquid carrier/98%–30% absorbent sheet). In one embodiment, the absorbent sheet has sufficient retention properties that the absorbent layer is a non-leaching absorbent. This means that the absorbent layer retains the carrier liquid with sufficient strength that ambient moisture and water in landfills will not remove solvent in an amount that would be prohibited by regulatory provisions. In one embodiment, a standard for absorption is where a non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C. and 40% relative humidity. In another embodiment, the absorbent layer is capable of absorbing carrier liquid from a freshly deposited liquid toner image and subsequently desorbing the carrier liquid upon application of heat or pressure. The absorbent layer may be continuous, completely solid, a matrix of materials, discontinuous or porous.

As noted earlier, the imaging apparatus may provide the absorbent sheet (which is capable of absorbing carrier liquid from an image and may be capable of subsequently desorbing the carrier liquid). In one embodiment, the sheets may be treated to desorb the absorbed liquid carrier either singly or in a cartridge upon application of heat or pressure.

As also noted earlier, the absorbent sheet may have an additional element of an inner layer which may be oleophobic. The absorbent sheet with the inner layer may additionally have any or all of the features and embodiments described above.

In another aspect of the invention, the electrophotographic imaging apparatus of the invention may be alternatively described as having the ability to remove excess liquid carrier from an intermediate transfer member surface. The electrophotographic imaging apparatus might then comprise a first element of an electrophotographic imaging system capable of providing an electrophotographic image on an intermediate transfer member; a second element consisting of an absorbent (liquid carrier absorbent) image drying sheet which contacts the intermediate transfer member, one feature of the image drying sheet having at least an outer layer which absorbs carrier liquid, one embodiment of the surface of the drying sheet in contact with the intermediate transfer member having a Shore A hardness of 10 to 60. One element of this aspect of the invention is that the drying sheet, after contacting the intermediate transfer member surface from which the toned image has been transferred, absorbs carrier liquid from a surface of the intermediate transfer member and the drying sheet then becomes a used drying sheet. In one embodiment, the apparatus preferably has a disbursing cartridge element for supplying non-saturated drying sheets for use and a receiving cartridge element for receiving used drying sheets. In another embodiment, the supply cartridge and the disbursing cartridge may be within a single housing. In an additional embodiment, there may be a heating element in the apparatus for evaporating carrier liquid from used drying sheets or a pressurizing zone for pressing liquid carrier from the absorbent sheet.

In another aspect of the invention, a method of drying or reducing the liquid carrier content of a liquid toner image or an intermediate transfer member surface may comprise steps such as providing at least one absorbent drying sheet and providing an electrophotographic apparatus. The electrophotographic apparatus should have at least an intermediate transfer member, at least one supply container and at least one discard container for the at least one absorbent drying sheet. Further steps include providing a toned image on the intermediate transfer member with a liquid toner; contacting an absorbent drying sheet from the supply container to the toned image on the intermediate transfer member or to the intermediate transfer member itself after the image is transferred away; and absorbing liquid carrier with the drying sheet, the drying sheet then becoming a used drying sheet. Various means can determine whether the used drying sheet is suitable for reuse as an absorbent drying sheet; and a final step might include placing the used drying sheet in a container selected from the group consisting of: supply container, re-supply container, regeneration container, or discard container depending upon the used drying sheet's suitability for further use. A final step may alternatively include the use of a regeneration container wherein heat is applied to the used drying sheets causing at least a portion of the absorbed carrier to be expelled from the substantially saturated drying sheets thereby converting substantially saturated drying sheets to non-saturated drying sheets. A final step may also or in the alternative use a regeneration container wherein pressure is applied to the used drying sheets causing at least a portion of the absorbed carrier to be expelled from the substantially saturated drying sheets thereby converting substantially saturated drying sheets to non-saturated drying sheets. If a discard container is used as a final step, the container and/or the sheets maybe recycled or disposed of (if landfillability requirements are met, as discussed above) either before or after regeneration.

Another aspect of the invention is a method of removing carrier liquid from a liquid toner image on an intermediate transfer member or from an intermediate transfer member after transfer of a liquid toner image to a final substrate. Some of the steps in this process include providing a plurality of absorbent drying sheets in a cartridge, wherein the sheets are stacked such that there is a top of the stack and a bottom of the stack; and providing an electrophotographic apparatus comprising at least an intermediate transfer member and a cartridge of drying sheets. A toned image is provided on the intermediate transfer member; and in one embodiment, an absorbent drying sheet from the cartridge is contacted to the toned image on the intermediate transfer member. In another embodiment, an absorbent drying sheet from the cartridge is contacted to the intermediate transfer member itself after the image is transferred away, in either case the drying sheet after absorbing liquid carrier becoming a used drying sheet. Additional steps include replacing the used drying sheet at the top of the stack in the absorbent drying sheet cartridge for re-supply or discard. By using non-leachable absorbent layers and non-leachable absorbent sheets (as described above, such that the used or substantially saturated sheets meet current regulatory requirements), the cartridge may be removed when it is filled with used or substantially saturated drying sheets and may be disposed of in a landfill. Alternative final steps include applying heat to the used drying sheets causing at least a portion of the absorbed carrier to be expelled from the substantially saturated drying sheets thereby converting the cartridge of substantially saturated drying sheets to non-saturated drying sheets. A final step may also use pressure or in the alternative use pressure applied to the used drying sheets causing at least a portion of the absorbed carrier to be expelled from the used drying sheets thereby converting used drying sheets to non-saturated drying sheets Another aspect of the present invention is also a method of drying carrier liquid from a toner image on an intermediate transfer member or from an intermediate transfer member after transfer to a final substrate. Some of the steps for this method include providing an electrophotographic apparatus comprising at least an intermediate transfer member and a continuous drying sheet. The continuous absorbent drying sheet has a beginning and an end, with the beginning attached to a take-up roller or spool and the end attached to a supply roller or spool in one embodiment, the intermediate portion thereof coiled around a supply spool with at least a portion of the sheet contacting the photoreceptor. Further steps include providing a toned image on the intermediate transfer member and contacting the continuous absorbent drying sheet to the toned image on the intermediate transfer member, or to the intermediate transfer member itself after the image is transferred away, creating a used portion of the continuous absorbent drying sheet; and simultaneously disbursing fresh length of the continuous absorbent drying sheet and taking-up the used portion of the continuous drying sheet. As discussed above, if the absorbent layer of the continuous absorbent drying sheet is non-leachable within regulatory standards, the discard or take-up spool may be landfilled. In another embodiment, the used drying sheet may be recycled.

These and other non-limiting aspects of the invention will be seen from the following examples.

DETAILED DESCRIPTION OF THE INVENTION

A method and materials are used in an apparatus to reduce the presence of excess carrier liquid and excess liquid toner after application of a liquid toner to a latent image on an intermediate transfer sheet, belt or roller. The invention describes a liquid electrophotographic imaging apparatus (in various embodiments, using various methods) containing at least one drying element (e.g., a sheet, stack of sheets, serrated (lines of separation perforations) sheet, or continuous sheet in roller form) for removing excess carrier liquid. The excess carrier liquid is present from the deposited or plated toner.

In this description, "substantially saturated" means that the absorbent drying member has absorbed sufficient carrier liquid to be ineffective as an absorbent, as indicated by poor absorbing performance or as indicated by a sensor determining percentage of carrier absorbed by weight. An absorbent material takes material that is being retained (absorbed) into a volume (three dimensions) of the absorbent material, while an adsorbent material retains material on its surface (a two dimensional phenomenon) with only incidental penetration of the adsorbed material into the volume (three-dimensions) of the adsorbent material.

Figure 1:
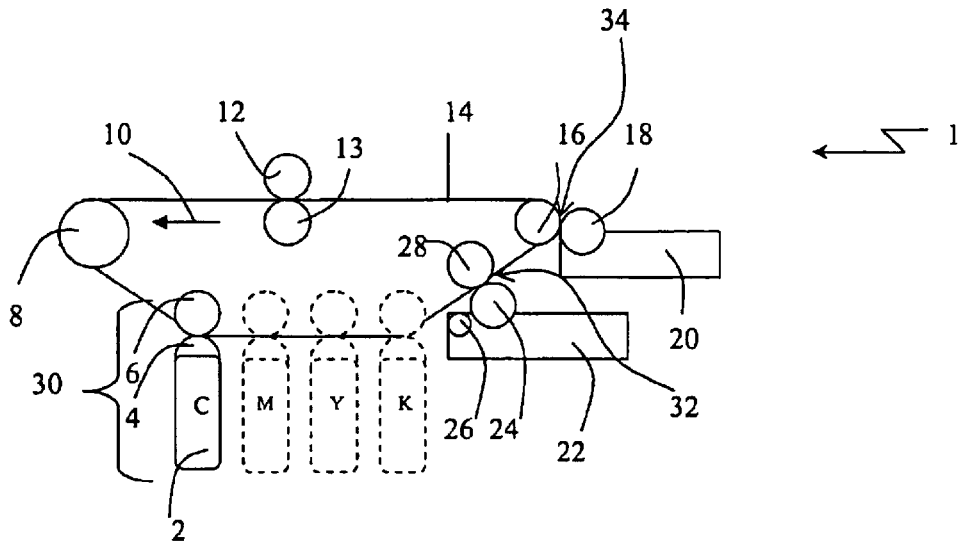
FIG. 1 shows one embodiment of an electrophotographic apparatus using drying sheets with supply and discard cartridges to dry an image on an intermediate transfer member.

FIG. 1 is a side view of one embodiment of a printing apparatus 1 using the claimed articles and one embodiment of the claimed method. In liquid electrophotographic printing, the toner image transferred to an intermediate transfer member is initially typically no more than 30%, and often no more than 25%, and most typically about 22% solids (e.g., a preferred range being between about 15–30%, 18–25%, or 19–24% solids). In cases of adhesive transfer, it is necessary to dry the toned image to be approximately 70% solids (e.g., 50–100% solids, or 60–80% solids) so that the ink can form a sticky film, thereby permitting transfer to the final medium. The apparatus 1 shown comprises at least one image development station 30 comprised of a toner cartridge 2 which might contain a developer (not shown) for electrostatically plating ink solids from liquid carrier to a photoreceptor drum 4 or belt (not shown), and a backup roller 6 to create a nip. A monochrome printer may have as few as one development station 30, but a multi-color printer will have a plurality of image development stations (shown in FIG. 1 with dashed lines). A toned image is generated on a photoreceptor 4 (method not described) and, in this embodiment, is transferred to an intermediate transfer member 14 (shown here in this non-limiting figure as a belt). The generation of this toned image is the source of the carrier liquid on the intermediate transfer member. The excess liquid carrier is present in a liquid toner toned latent image on an intermediate transfer member surface 14 or remains on the intermediate transfer member surface 14 after the toned but not fused or permanently adhered liquid toner image is transferred to another intermediate surface or to the final image receiving surface (not shown). The intermediate transfter belt or drum 14 is supported and tensioned by rollers 8, 16. The intermediate transfer member moves in a direction indicated by arrow 10 through each image development station 30, receiving toned images. The final destination of the composite toned image is shown here between rollers 12, 13 where it is transferred to the final substrate (not shown). The transfer step can be accomplished using adhesive transfer or electrostatic transfer methods, or a combination of both. As can be seen from FIG. 1, nearly all rollers in the electrophotographic printer require a backup roller when contacting a belt because of a need for nip pressure. When, for example, an intermediate transfer drum is used, the drum itself becomes the back pressure needed to form the nip. The inclusion, therefore, of roller 28 in FIG. 1 is to form a nip 32 with a drying sheet supply roller 24.

Container or cartridge 22 holds a supply of non-saturated absorbent drying sheets (not shown). At least one drying sheet (in its varied forms) may be present as a flexible substrate having a first surface and second surface and at least one oleophilic carrier liquid absorptive layer on the first surface of the flexible substrate. The first surface of the flexible substrate faces the intermediate transfer member surface or liquid toned latent image when it is placed in position to absorb liquid carrier. The absorbent sheet may be provided from a carrier tray 22 (e.g., stacked within the tray and individually positioned to absorb the liquid carrier from the intermediate transfer member surface), from a roller of sheets (which may be separate sheets that overlap to retain sheets in place underneath them), a serrated roll of sheets where modest force will remove a sheet from the roll (not shown), or a continuous sheet wound on a supply roll and taken up on a discard roll or spool (not shown in FIG. 1, but shown and discussed later) as 70, 72, 74 in FIG. 5). The first surface and second surface both may have an oleophilic absorptive layer affixed to each of the first surface and the second surface. This would enable both sides of the substrate to be utilized. The absorbent sheet may have a compliant inner layer affixed between the flexible substrate and the at least one oleophilic carrier liquid absorptive layer. The inner layer may be oleophobic to carrier liquid and may be at least less oleophilic then the absorbent layer. The inner layer typically comprises a polymer selected from nitrile elastomers, fluorosilicone polymers, fluorocarbon polymers, and polyurethane polymers.

The substrate of the absorbent sheet may be opaque or substantially transparent and may comprise one or more layers of appropriately selected materials. The substrate may be constructed of or comprise any suitable components giving the desired properties as described herein. Non-limiting examples of suitable materials for the substrate are polyester such as polyethylene terephthalate and polyethylene naphthalate, polyimide, polysulfone, cellulose triacetate, polyamide, polyolefins, polycarbonate, vinyl resins such as polyvinyl chloride, polyvinylbutyral and polystyrene, and the like. Specific examples of supporting substrates included polyethersulfone (Stabar® S-100 polymer, commercially available from ICI), polyvinyl fluoride (Tedlar® polymer, commercially available from E.I. DuPont de Nemours & Company), polybisphenol-A polycarbonate (Makrofol® film, commercially available from Mobay Chemical Company) and amorphous polyethylene terephthalate (Melinar®, commercially available from ICI Americas, Inc. and Dupont A and Dupont 442, commercially available from E.I. DuPont de Nemours & Company).

The desired thickness of the substrate of the absorbing member depends on a number of factors, including economic considerations. The substrate typically is between 10 microns and 1000 microns thick, preferably between 25 microns and 250 microns. When the absorbent sheet is used in a liquid electrophotographic imaging apparatus, the thickness of the substrate should be selected to avoid any adverse affects on the final device and process. The substrate should not be so thin that it splits, wrinkles and/or exhibits poor durability characteristics. The substrate likewise should not be so thick that it may give rise to early failure during cycling, a lower flexibility, and a higher cost for unnecessary material.

The absorbent material in the absorbent layer of the at least one layer absorbing member should be mechanically durable and have a high affinity to the carrier fluids, e.g. hydrocarbons, in the liquid inks. Non-limiting examples of suitable absorbent material are silicone polymer or polysiloxane, fluorosilicone polymer, polyethylene, polypropylene, or a combination thereof. Preferably, the absorbing material is selected from the group consisting of cross-linked silicone polymers and fluorosilicone polymers. The layer is preferably porous at the surface to enable some absorption or flow of liquid into the surface as opposed to only surface adhesion or adsorption.

The absorbent layer should not be too thin that it has a limiting absorption capacity that would be insufficient to enable absorption of liquid carrier at levels anticipated in the use of the system and process. The absorbent layer likewise should not be so thick that it may give rise to cracking, delamination from the sheet substrate, and higher cost for unnecessary material. In general, the thickness of the absorbent layer is greater than or equal to about 25 microns, preferably in the range of about 25 to about 1000 microns, more preferably in the range of 25 to 250 microns.

Optional conventional additives, such as, for example, adhesion promoters, surfactants, fillers, expandable particles, coupling agents, silanes, photoinitiators, fibers, lubricants, wetting agents, pigments, dyes, plasticizers, release agents, suspending agents, cross-linking agents, catalysts, and curing agents, may be included in the absorbent layer either for manufacturing requirements of the layer or performance property controls in the layer during use in the practice of the present invention.

The preferred absorbent materials are cross-linked silicone polymers and cross-linked fluorosilicone polymers. The cross-linking of the silicone polymers and fluorosilicone polymers can be undertaken by any of a variety of methods including free radical reactions, condensation reactions, hydrosilylation addition reactions, hydrosilane/silanol reactions, and thermally initiated or photoinitiated reactions relying on the activation of an intermediate to induce subsequent cross-linking.

Preferably, the cross-linking agent is present in an amount of greater than about 0 to about 20, such as 0.1 to 20 parts by weight of the preferably about 5 to about 15, and more preferably about 8 to about 12, parts by weight.

Commercially available examples of a cross-linking agent include those commercially available under the trade designations SYL-OFF® 7048 and 7678 (from Dow Corning, Midland, Mich.), SYLGARD™ 186 (from Dow Corning, Midland, Mich.), NM203, PS 122.5 and PS 123 (from Huls America Inc.), DC7048 (Dow Corning Corp.), F-9W-9 (Shin Etsu Chemical Co. Ltd.) and VXL (O Si Specialties).

The above components for the absorbent material are preferably reacted in the presence of a catalyst capable of catalyzing addition cross-linking of the above components to form an adsorbent release coating composition. Suitable catalysts include the transition metal catalysts described for hydrosilylation in *The Chemistry of Organic Silicone Compounds,* Ojima, (S. Patai, J. Rappaport eds., John Wiley and Sons, New York 1989). Such catalysts may be either heat or radiation activated. Examples include, but are not limited to, alkene complexes of Pt(II), phosphine complexes of Pt(I) and Pt(O), and organic complexes of Rh(I). Choroplatinic acid based catalysts are the preferred catalysts. Inhibitors may be added as necessary or desired in order to extend the pot life and control the reaction rate. Commercially available hydrosilation and hydrosilylation catalysts based on chloroplatinic acid include those available under the trade designations: PC 075, PC 085 (Huls America Inc.), Syl-Off™ 7127, Syl-Off™ 7057, Syl-Off™ 4000 (all from Dow Corning Corp.), SL 6010-D1 (General Electric), VCAT-RT, VCAT-ET (O Si Specialties), and PL-4 and PL-8 (Shin Etsu Chemical Co. Ltd.).

Other cross-linking reactions may also be used to form the cross-linked silicone polymer with a bimodal distribution of chain lengths between cross-links. Cross-linking reactions that have been used include free radical reactions, condensation reactions, hydrosilylation addition reactions, and hydrosilane/silanol reactions. Cross-linking may also result from photoinitiated reactions relying on the activation of an intermediate to induce subsequent cross-linking.

Peroxide induced free radical reactions that rely on the availability of C—H bonds present in the methyl side groups provide a non-specific cross-link structure that would not result in the desired network structure. However, the use of siloxanes containing vinyl groups with vinyl specific peroxides could provide the desired structure given the appropriate choice of starting materials. Free radical reactions can also be activated by UV light or other sources of high energy radiation, e.g., electron beams.

The condensation reaction can occur between complementary groups attached to the siloxane backbone. Isocyanate, epoxy, or carboxylic acids condensing with amine or hydroxy functionalities have been used to cross-link siloxanes. More commonly, the condensation reaction relies on the ability of some organic groups attached to silicon to react with water, thus providing silanol groups which further react with either the starting material or other silanol group to produce a cross-link. It is known that many groups attached to silicon are readily hydrolyzable to produce silanol groups. In particular, alkoxy, acyloxy, and oxime groups are known to undergo this reaction. In the absence of moisture, these groups do not react, and therefore, provide a sufficient working life relative to unprotected silanol groups. On exposure to moisture, these groups spontaneously hydrolyze and condense. These systems may be catalyzed as necessary. A subset of these systems includes tri- or tetra-functional silanes containing three or four hydrolyzable groups.

Hydrosilane groups can react in a similar manner as described for the condensation reaction. They can react directly with SiOH groups or may first be converted to an OH group by reaction with water before condensing with a second SiOH moiety. The reaction may be catalyzed by either condensation or hydrosilylation catalysts.

The hydrosilylation addition reaction relies on the ability of the hydrosilane bond to add across a carbon-carbon double bond in the presence of a noble metal catalyst. Such reactions are widely used in the synthesis of organofunctional siloxanes and to prepare release liners for pressure sensitive adhesives.

Well known photoinitiated reactions can be adapted to cross-link siloxanes. Organofunctional groups such as cinnamates, acrylates, epoxies, etc., can be attached to the siloxane backbone. Additionally, the photoinitiators may be grafted onto the siloxane backbone for improved solubility. Other examples of this chemistry include addition of a thiol across a carbon-carbon double bond (typically, an aromatic ketone initiator is required), hydrosilane/ene addition (the free radical equivalent of the hydrosilylation reaction), acrylate polymerization (can also be electron beam activated), and radiation induced cationic polymerization of epoxides, vinyl ethers, and other functionalities.

Other useful additives for the absorbent layer are expandable particles, both blowable and non-blowable. Non-limiting examples of expandable particles are Expancel™ microspheres (commercially obtained from Expancel, Inc., Duluth, Ga.), Expandable Polystyrene Bead (commercially obtained from StyroChem International, Fort Worth, Tex.), Matsumoto Microsphere F series (commercially obtained from Matsumoto Yushi-Seiyaku Co., Ltd., Osaka, Japan), Dualite™ M6050AE (commercially available from Sovereign Specialty Chemicals, Akron, Ohio). The preferred expandable particles are Expancel™ microspheres and Matsumoto Microsphere F series. Particulate materials allow for some natural porosity in the layer, in addition to surface tension adsorption on the material itself. Expandable means that the particles are able to enlarge their volume upon activation, such as by heat, radiant energy, solvent/liquid activation, or the like. They may release gases by decomposition or from entrapment or undergo chemical reactions or other processes that cause the volume of the spheres to change upwardly.

Expancel™ microspheres are small spherical plastic particles. The microspheres consist of a polymer shell encapsulating a gas. When the gas inside the shell is heated, it increases its pressure and the thermoplastic shell softens, resulting in a dramatic increase in the volume of the microspheres. When fully expanded, the volume of the microspheres may increases up to more than 40 times. The product range includes both unexpanded and expanded microspheres. Unexpanded microspheres are used as blowing agents in many areas such as printing inks, paper, textiles, polyurethanes, PVC-plastics and more. The expanded microspheres are used as lightweight fillers in various applications.

Matsumoto Microsphere F series are thermo-expandable micro spheres having 10 to 30 microns diameter produced by encapsulating low-boiling-point hydrocarbons with a wall of copolymers of vinylidene chloride, acrylonitrile and the like through in-situ polymerization. They are mixed with various resins and formed into a layer containing separate pores at low temperature for a short time through the steps of coating, impregnating or kneading.

The expandable particles can be mixed with resins or absorbent materials by a variety of conventional mixing techniques including hand stirring, propeller mixing, Cowles or high shear mixing, roller mixing, homogenization, and microfluidization. The weight ratio of expandable particles to absorbing materials ranges from 0.5 to 25%. Preferably, the weight ratio is between 4 and 10%.

One skilled in the art would know that when a sheet is coated on both sides and a "tacky" or "sticky" absorbent layer is used, the absorbent surfaces that contact one another may adhere. One skilled in the art would know to formulate the absorbent coating composition to modify the stickiness of the surface.

The apparatus may provide sheet handling systems that move the drying sheet from a storage area or supply area to position the drying sheet into contact with a surface of a photoreceptor where the sheet will be able to contact carrier liquid. This drying sheet can assist in more rapidly and controllably changing the toner image to the desired liquid carrier content and properties. If the applied liquid toner has a solids content of between 20–25% by weight, the absorbent sheet should be able to convert the solid content to at least 40% with three seconds contact and 50 g/cm$^2$ pressure on the sheet. The absorbent layer of the sheet may have a surface energy that is at least 1 dyne/cm less than the surface energy of the surface it is positioned to contact and to dry.

It is possible that the absorbent may have sufficient retention properties that the absorbent layer is a non-leaching absorbent. This means that the absorbent layer retains the carrier liquid with sufficient strength that ambient moisture and water in landfills will not remove solvent in an amount that would be prohibited by regulatory provisions. An example of a standard for absorption is where a non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C. and 40% relative humidity.

Alternatively, the absorbent layer may be capable of absorbing carrier liquid from a freshly deposited liquid toner image and subsequently desorbing the carrier liquid upon application of heat or pressure.

Once a toner image is transferred to the intermediate transfer member 14, a non-saturated drying sheet is selected and readied (positioned for feeding into the system) in the cartridge. The optional inclusion of a feeder roller 26 can help. As the toner image nears the nip 32, the non-saturated drying sheet (not shown) may be applied to the surface of the image (which faces supply roller 24), passing together with the intermediate transfer member 14 and the image through the nip 32. The imaging apparatus of this invention should provide a drying sheet is capable of absorbing 2%–70% of its own weight in carrier liquid (e.g., 2–70% liquid carrier/98%–30% absorbent sheet). The surfaces remain in contact until after passing through nip 34 formed by rollers 16, 18. After passing though the nip 34, the drying sheet, which has now been used, is stored for re-use in a recycle storage container (device not shown) or discarded in a discard container or cartridge 18. Contact time and choice of absorbent material will determine final dryness or moisture of the image. If adhesive transfer is used, the image will need to be at least 50% solids by weight. If electrostatic transfer is used, the image will need to be less than 40% solids by weight. If a regeneration means is used for the drying sheets or pads (not shown, but general means for regenerating sheets containing volatile liquids are known in the art), when the original supply cartridge 22 is emptied, the cartridge 18 with the regenerated sheets can be simply exchanged for the original supply cartridge 22 without calling service personnel.

Figure 2:
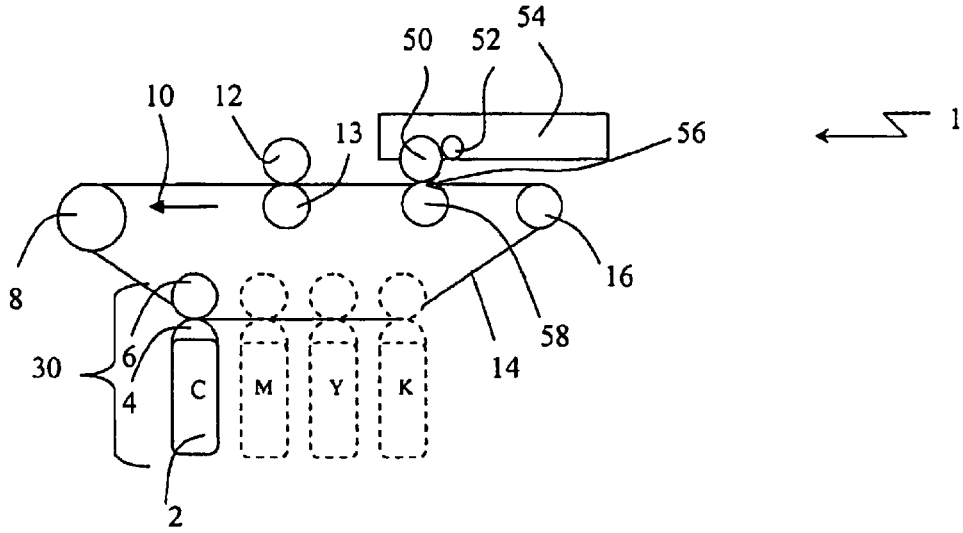
FIG. 2 shows one embodiment of an electrophotographic apparatus using drying sheets to dry an image on an intermediate transfer member with one cartridge for both supply and discard.

FIG. 2 is a side view of one embodiment of a printing apparatus 1 using one embodiment of the claimed method. In liquid electrophotographic printing, the toner image plated to a photoreceptor and transferred to an intermediate transfer member is initially typically no more than 30%, and often no more than 25%, and most typically about 22% solids (e.g., a preferred range being between about 15–30%, 18–25%, or 19–24% solids). In cases of adhesive transfer, it is necessary to dry the toned image to be approximately 70% solids (e.g., 50–100% solids, or 60–80% solids) so that the ink can form a sticky film, thereby permitting transfer to the final medium. The apparatus 1 shown comprises at least one image development station 30 comprised of a toner cartridge 2 which might contain a developer (not shown) for electrostatically plating ink solids from liquid carrier to a photoreceptor drum 4 or belt (not shown), and a backup roller 6 to create a nip. A monochrome printer may have as few as one development station 30, but a multi-color printer will have a plurality of image development stations (shown in FIG. 2 with dashed lines). A toned image is generated on a photoreceptor 4 (method not described) and, in this embodiment, is transferred to an intermediate transfer member 14 (shown here in this non-limiting figure as a belt). The generation of this toned image is the source of the carrier liquid on the intermediate transfer member. The excess liquid carrier is present in a liquid toner toned image on an intermediate transfer member surface 14 or remains on the intermediate transfer member surface 14 after the toned but not fused or permanently adhered liquid toner image is transferred to another intermediate surface or to the final image receiving surface (not shown). The intermediate transfer belt 14 is supported and tensioned by rollers 8, 16. The intermediate transfer member moves in a direction indicated by arrow 10 through each image development station 30, receiving toned images. The final destination of the composite toned image is shown here between rollers 12, 13 where it is transferred to the final substrate (not shown). The transfer step can be accomplished using adhesive transfer or electrostatic transfer methods, or a combination of both. As can be seen from FIG. 2, nearly all rollers in the electrophotographic printer require a backup roller when contacting a belt because of a need for nip pressure. When, for example, an intermediate transfer drum is used, the drum itself becomes the back pressure needed to form the nip. The inclusion, therefore, of roller 58 in FIG. 2 is to form a nip 56 with a drying sheet supply roller 50.

Container or cartridge 54 holds a supply of non-saturated absorbent drying sheets (not shown). At least one drying sheet (in its varied forms) may be present as a flexible substrate having a first surface and second surface and at least one oleophilic carrier liquid absorptive layer on the first surface of the flexible substrate. The first surface of the flexible substrate faces the photoreceptor surface, latent image or liquid toned latent image when it is placed in position to absorb liquid carrier. The absorbent sheet may be provided from a carrier tray 54 (e.g., stacked within the tray and individually positioned to absorb the liquid carrier from the photoreceptor surface), from a roller of sheets (which may be separate sheets that overlap to retain sheets in place underneath them), a serrated roll of sheets where modest force will remove a sheet from the roll (not shown), or a continuous sheet wound on a supply roll and taken up on a discard roll or spool (not shown in FIG. 2, but shown and discussed later as 70, 72, 74 in FIG. 5). The first surface and second surface both may have an oleophilic absorptive layer affixed to each of the first surface and the second surface. This would enable both sides of the substrate to be utilized. The absorbent sheet may have a compliant inner layer affixed between the flexible substrate and the at least one oleophilic carrier liquid absorptive layer. The inner layer may be oleophobic to carrier liquid and may be at least less oleophilic then the absorbent layer. The inner layer typically comprises a polymer selected from nitrile elastomers, fluorosilicone polymers, fluorocarbon polymers, and polyurethane polymers.

The substrate of the absorbent sheet may be opaque or substantially transparent and may comprise one or more layers of appropriately selected materials. The substrate may be constructed of or comprise any suitable components giving the desired properties as described herein. Non-limiting examples of suitable materials for the substrate are polyester such as polyethylene terephthalate and polyethylene naphthalate, polyimide, polysulfone, cellulose triacetate, polyamide, polyolefins, polycarbonate, vinyl resins such as polyvinyl chloride, polyvinylbutyral and polystyrene, and the like. Specific examples of supporting substrates included polyethersulfone (Stabar® S-100 polymer, commercially available from ICI), polyvinyl fluoride (Tedlar® polymer, commercially available from E.I. DuPont de Nemours & Company), polybisphenol-A polycarbonate (Makrofol® film, commercially available from Mobay Chemical Company) and amorphous polyethylene terephthalate (Melinar®, commercially available from ICI Americas, Inc. and Dupont A and Dupont 442, commercially available from E.I. DuPont de Nemours & Company).

The desired thickness of the substrate of the absorbing member depends on a number of factors, including economic considerations. The substrate typically is between 10 microns and 1000 microns thick, preferably between 25 microns and 250 microns. When the absorbent sheet is used in a liquid electrophotographic imaging member, the thickness of the substrate should be selected to avoid any adverse affects on the final device and process. The substrate should not be so thin that it splits, wrinkles and/or exhibits poor durability characteristics. The substrate likewise should not be so thick that it may give rise to early failure during cycling, a lower flexibility, and a higher cost for unnecessary material.

The absorbent material in the absorbent layer of the at least one layer absorbing member should be mechanically durable and have a high affinity to the carrier fluids, e.g. hydrocarbons, in the liquid inks. Non-limiting examples of suitable absorbent material are silicone polymer or polysiloxane, fluorosilicone polymer, polyethylene, polypropylene, or a combination thereof. Preferably, the absorbing material is selected from the group consisting of cross-linked silicone polymers and fluorosilicone polymers. The layer is preferably porous at the surface to enable some absorption or flow of liquid into the surface as opposed to only surface adhesion or adsorption.

The absorbent layer should not be too thin that it has a limiting absorption capacity that would be insufficient to enable absorption of liquid carrier at levels anticipated in the use of the system and process. The absorbent layer likewise should not be so thick that it may give rise to cracking, delamination from the sheet substrate, and higher cost for unnecessary material. In general, the thickness of the absorbent layer is greater than or equal to about 25 microns, preferably in the range of about 25 to about 1000 microns, more preferably in the range of 25 to 250 microns.

Optional conventional additives, such as, for example, adhesion promoters, surfactants, fillers, expandable particles, coupling agents, silanes, photoinitiators, fibers, lubricants, wetting agents, pigments, dyes, plasticizers, release agents, suspending agents, cross-linking agents, catalysts, and curing agents, may be included in the absorbent layer either for manufacturing requirements of the layer or performance property controls in the layer during use in the practice of the present invention.

The preferred absorbent materials are cross-linked silicone polymers and cross-linked fluorosilicone polymers. The cross-linking of the silicone polymers and fluorosilicone polymers can be undertaken by any of a variety of methods including free radical reactions, condensation reactions, hydrosilylation addition reactions, hydrosilane/silanol reactions, and thermally initiated or photoinitiated reactions relying on the activation of an intermediate to induce subsequent cross-linking.

Preferably, the cross-linking agent is present in an amount of greater than about 0 to about 20, such as 0.1 to 20 parts by weight of the preferably about 5 to about 15, and more preferably about 8 to about 12, parts by weight.

Commercially available examples of a cross-linking agent include those commercially available under the trade designations SYL-OFF® 7048 and 7678 (from Dow Corning, Midland, Mich.), SYLGARD™ 186 (from Dow Corning, Midland, Mich.), NM203, PS 122.5 and PS 123 (from Huls America Inc.), DC7048 (Dow Corning Corp.), F-9W-9 (Shin Etsu Chemical Co. Ltd.) and VXL (O Si Specialties).

The above components for the absorbent material are preferably reacted in the presence of a catalyst capable of catalyzing addition cross-linking of the above components to form an adsorbent release coating composition. Suitable catalysts include the transition metal catalysts described for hydrosilylation in *The Chemistry of Organic Silicone Compounds,* Ojima, (S. Patai, J. Rappaport eds., John Wiley and Sons, New York 1989). Such catalysts may be either heat or radiation activated. Examples include, but are not limited to, alkene complexes of Pt(II), phosphine complexes of Pt(I) and Pt(O), and organic complexes of Rh(I). Choroplatinic acid based catalysts are the preferred catalysts. Inhibitors may be added as necessary or desired in order to extend the pot life and control the reaction rate. Commercially available hydrosilation and hydrosilylation catalysts based on chloroplatinic acid include those available under the trade designations: PC 075, PC 085 (Huls America Inc.), Syl-Off™ 7127, Syl-Off™ 7057, Syl-Off™ 4000 (all from Dow Coming Corp.), SL 6010-D1 (General Electric), VCAT-RT, VCAT-ET (O Si Specialties), and PL-4 and PL-8 (Shin Etsu Chemical Co. Ltd.).

Other cross-linking reactions may also be used to form the cross-linked silicone polymer with a bimodal distribution of chain lengths between cross-links. Cross-linking reactions that have been used include free radical reactions, condensation reactions, hydrosilylation addition reactions, and hydrosilane/silanol reactions. Cross-linking may also result from photoinitiated reactions relying on the activation of an intermediate to induce subsequent cross-linking.

Peroxide induced free radical reactions that rely on the availability of C—H bonds present in the methyl side groups provide a non-specific cross-link structure that would not result in the desired network structure. However, the use of siloxanes containing vinyl groups with vinyl specific peroxides could provide the desired structure given the appropriate choice of starting materials. Free radical reactions can also be activated by UV light or other sources of high energy radiation, e.g., electron beams.

The condensation reaction can occur between complementary groups attached to the siloxane backbone. Isocyanate, epoxy, or carboxylic acids condensing with amine or hydroxy functionalities have been used to cross-link siloxanes. More commonly, the condensation reaction relies on the ability of some organic groups attached to silicon to react with water, thus providing silanol groups which further react with either the starting material or other silanol group to produce a cross-link. It is known that many groups attached to silicon are readily hydrolyzable to produce silanol groups. In particular, alkoxy, acyloxy, and oxime groups are known to undergo this reaction. In the absence of moisture, these groups do not react, and therefore, provide a sufficient working life relative to unprotected silanol groups. On exposure to moisture, these groups spontaneously hydrolyze and condense. These systems may be catalyzed as necessary. A subset of these systems includes tri- or tetra-functional silanes containing three or four hydrolyzable groups.

Hydrosilane groups can react in a similar manner as described for the condensation reaction. They can react directly with SiOH groups or may first be converted to an OH group by reaction with water before condensing with a second SiOH moiety. The reaction may be catalyzed by either condensation or hydrosilylation catalysts.

The hydrosilylation addition reaction relies on the ability of the hydrosilane bond to add across a carbon-carbon double bond in the presence of a noble metal catalyst. Such reactions are widely used in the synthesis of organofunctional siloxanes and to prepare release liners for pressure sensitive adhesives.

Well known photoinitiated reactions can be adapted to cross-link siloxanes. Organofunctional groups such as cinnamates, acrylates, epoxies, etc., can be attached to the siloxane backbone. Additionally, the photoinitiators may be grafted onto the siloxane backbone for improved solubility. Other examples of this chemistry include addition of a thiol across a carbon-carbon double bond (typically, an aromatic ketone initiator is required), hydrosilane/ene addition (the free radical equivalent of the hydrosilylation reaction), acrylate polymerization (can also be electron beam activated), and radiation induced cationic polymerization of epoxides, vinyl ethers, and other functionalities.

Other useful additives for the absorbent layer are expandable particles, both blowable and non-blowable. Non-limiting examples of expandable particles are Expancel™ microspheres (commercially obtained from Expancel, Inc., Duluth, Ga.), Expandable Polystyrene Bead (commercially obtained from StyroChem International, Fort Worth, Tex.), Matsumoto Microsphere F series (commercially obtained from Matsumoto Yushi-Seiyaku Co., Ltd., Osaka, Japan), Dualite™ M6050AE (commercially available from Sovereign Specialty Chemicals, Akron, Ohio). The preferred expandable particles are Expancel™ microspheres and Matsumoto Microsphere F series. Particulate materials allow for some natural porosity in the layer, in addition to surface tension adsorption on the material itself.

Expancel™ microspheres are small spherical plastic particles. The microspheres consist of a polymer shell encapsulating a gas. When the gas inside the shell is heated, it increases its pressure and the thermoplastic shell softens, resulting in a dramatic increase in the volume of the microspheres. When fully expanded, the volume of the microspheres may increases up to more than 40 times. The product range includes both unexpanded and expanded microspheres. Unexpanded microspheres are used as blowing agents in many areas such as printing inks, paper, textiles, polyurethanes, PVC-plastics and more. The expanded microspheres are used as lightweight fillers in various applications.

Matsumoto Microsphere F series are thermo-expandable micro spheres having 10 to 30 microns diameter produced by encapsulating low-boiling-point hydrocarbons with a wall of copolymers of vinylidene chloride, acrylonitrile and the like through in-situ polymerization. They are mixed with various resins and formed into a layer containing separate pores at low temperature for a short time through the steps of coating, impregnating or kneading.

The expandable particles can be mixed with resins or absorbent materials by a variety of conventional mixing techniques including hand stirring, propeller mixing, Cowles or high shear mixing, roller mixing, homogenization, and microfluidization. The weight ratio of expandable particles to absorbing materials ranges from 0.5 to 25%. Preferably, the weight ratio is between 4 and 10%.

The apparatus may provide sheet handling systems that move the drying sheet from a storage or supply area to position the drying sheet into contact with a surface of an intermediate transfer member where the sheet will be able to contact carrier liquid. This drying sheet can assist in more rapidly and controllably changing the toner image to the desired liquid carrier content and properties. If the applied liquid toner has a solids content of between 20–25% by weight, the absorbent sheet should be able to convert the solid content to at least 40% with three seconds contact and 50 g/cm$^2$ pressure on the sheet. The absorbent layer of the sheet may have a surface energy that is at least 1 dyne/cm less than the surface energy of the surface it is positioned to contact and to dry.

It is possible that the absorbent may have sufficient retention properties that the absorbent layer is a non-leaching absorbent. This means that the absorbent layer retains the carrier liquid with sufficient strength that ambient moisture and water in landfills will not remove solvent in an amount that would be prohibited by regulatory provisions. An example of a standard for absorption is where a non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C. and 40% relative humidity.

Alternatively, the absorbent layer may be capable of absorbing carrier liquid from a freshly deposited liquid toner image and subsequently desorbing the carrier liquid upon application of heat or pressure.

Once a toner image is transferred to the intermediate transfer member 14, a non-saturated drying sheet is selected and readied (positioned for feeding into the system) in the cartridge 54. The optional inclusion of a feeder roller 52 can help. As the toner image nears the nip 56, the non-saturated drying sheet (not shown) may be applied to the surface of the image (which faces supply roller 50), passing together with the intermediate transfer member 14 and the image through the nip 56. The imaging apparatus of this invention should provide a drying sheet is capable of absorbing 2%–70% of its own weight in carrier liquid (e.g., 2–70% liquid carrier/98%–30% absorbent sheet). The surfaces remain in contact until after passing through nip 56 formed by rollers 50, 58. After passing through the nip 56, the drying sheet, which has now been used, is stored for re-use, recycling, or discard in container or cartridge 54. (If the sheet is coated with absorbent layers on both sides, one skilled in the art would know to store the sheet inverted so that the unused side is placed to contact the intermediate transfer member.) Contact time and choice of absorbent material will determine final dryness or moisture of the image. If adhesive transfer is used, the image will need to be at least 50% solids by weight. If electrostatic transfer is used, the image will need to be less than 40% solids by weight. Whether or not a regeneration means is used for the drying sheets or pads (not shown, but general means for regenerating sheets containing volatile liquids are known in the art), when the life of the sheets in the original cartridge 54 is exhausted, they can be simply exchanged for a new cartridge without calling service personnel.

Figure 3:
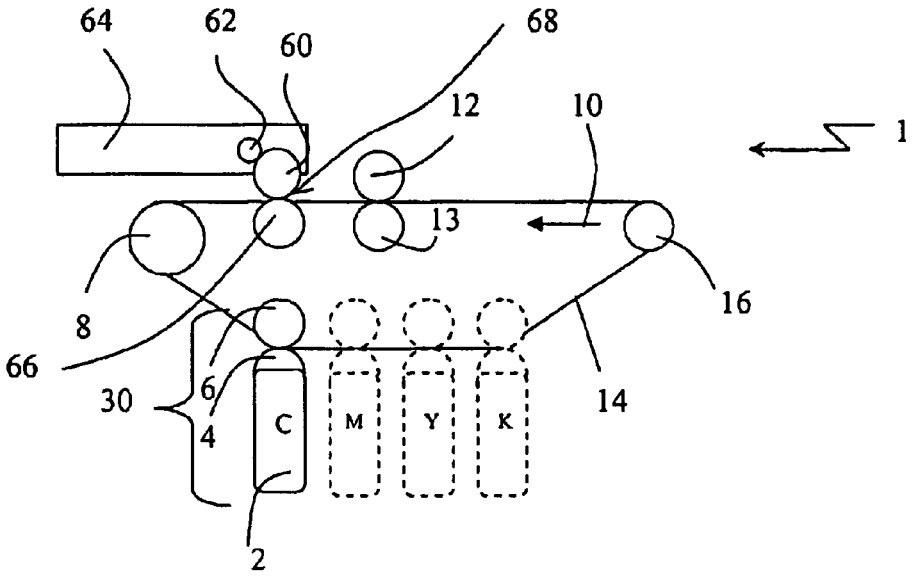
FIG. 3 shows one embodiment of an electrophotographic apparatus using drying sheets to dry an intermediate transfer member belt with one cartridge for both supply and discard.

FIG. 3 is a side view of one embodiment of a printing apparatus 1 using one embodiment of the claimed method,. The apparatus 1 shown comprises at least one image development station 30 comprised of a toner cartridge 2 which might contain a developer (not shown) for electrostatically plating ink solids from liquid carrier to a photoreceptor drum 4 or belt (not shown), and a backup roller 6 to create a nip. A monochrome printer may have as few as one development station 30, but a multi-color printer will have a plurality of image development stations (shown in FIG. 3 with dashed lines). A toned image is generated on a photoreceptor 4 (method not described) and, in this embodiment, is transferred to an intermediate transfer member 14 (shown here in this non-limiting figure as a belt). The generation of this toned image is the source of the carrier liquid on the intermediate transfer member. The excess liquid carrier may remain on the intermediate transfer member surface 14 after the toned but not fused or permanently adhered liquid toner image is transferred to another intermediate surface or to the final image receiving surface (not shown). The intermediate transfer member 14 may also pick up excess carrier from simply passing through one or more development stations 30. An intermediate transfer belt 14 is supported and tensioned by rollers 8, 16. The intermediate transfer member moves in a direction indicated by arrow 10 through each image development station 30, receiving toned images. The final destination of the composite toned image is shown here between rollers 12, 13 where it is transferred to the final substrate (not shown). The transfer step can be accomplished using adhesive transfer or electrostatic transfer methods, or a combination of both. As can be seen from FIG. 3, nearly all rollers in the electrophotographic printer require a backup roller when contacting a belt because of a need for nip pressure. When, for example, an intermediate transfer drum is used, the drum itself becomes the back pressure needed to form the nip. The inclusion, therefore, of roller 66 in FIG. 3 is to form a nip 68 with a drying sheet supply roller 60.

Container or cartridge 64 holds a supply of non-saturated absorbent drying sheets (not shown). At least one drying sheet (in its varied forms) may be present as a flexible substrate having a first surface and second surface and at least one oleophilic carrier liquid absorptive layer on the first surface of the flexible substrate. The first surface of the flexible substrate faces the intermediate transfer member surface when it is placed in position to absorb liquid carrier. The absorbent sheet may be provided from a carrier tray 64 (e.g., stacked within the tray and individually positioned to absorb the liquid carrier from the intermediate transfer member surface), from a roller of sheets (which may be separate sheets that overlap to retain sheets in place underneath them), a serrated roll of sheets where modest force will remove a sheet from the roll (not shown), or a continuous sheet wound on a supply roll and taken up on a discard roll or spool (not shown in FIG. 3, but shown and discussed later as 70, 72, 74 in FIG. 5). The first surface and second surface both may have an oleophilic absorptive layer affixed to each of the first surface and the second surface. This would enable both sides of the substrate to be utilized. The absorbent sheet may have a compliant inner layer affixed between the flexible substrate and the at least one oleophilic carrier liquid absorptive layer. The inner layer may be oleophobic to carrier liquid and may be at least less oleophilic then the absorbent layer. The inner layer typically comprises a polymer selected from nitrile elastomers, fluorosilicone polymers, fluorocarbon polymers, and polyurethane polymers.

The substrate of the absorbent sheet may be opaque or substantially transparent and may comprise one or more layers of appropriately selected materials. The substrate may be constructed of or comprise any suitable components giving the desired properties as described herein. Non-limiting examples of suitable materials for the substrate are polyester such as polyethylene terephthalate and polyethylene naphthalate, polyimide, polysulfone, cellulose triacetate, polyamide, polyolefins, polycarbonate, vinyl resins such as polyvinyl chloride, polyvinylbutyral and polystyrene, and the like. Specific examples of supporting substrates included polyethersulfone (Stabar® S-100 polymer, commercially available from ICI), polyvinyl fluoride (Tedlar® polymer, commercially available from E.I. DuPont de Nemours & Company), polybisphenol-A polycarbonate (Makrofol® film, commercially available from Mobay Chemical Company) and amorphous polyethylene terephthalate (Melinar®, commercially available from ICI Americas, Inc. and Dupont A and Dupont 442, commercially available from E.I. DuPont de Nemours & Company).

The desired thickness of the substrate of the absorbing member depends on a number of factors, including economic considerations. The substrate typically is between 10 microns and 1000 microns thick, preferably between 25 microns and 250 microns. When the absorbent sheet is used in a liquid electrophotographic imaging member, the thickness of the substrate should be selected to avoid any adverse affects on the final device and process. The substrate should not be so thin that it splits, wrinkles and/or exhibits poor durability characteristics. The substrate likewise should not be so thick that it may give rise to early failure during cycling, a lower flexibility, and a higher cost for unnecessary material.

The absorbent material in the absorbent layer of the at least one layer absorbing member should be mechanically durable and have a high affinity to the carrier fluids, e.g. hydrocarbons, in the liquid inks. Non-limiting examples of suitable absorbent material are silicone polymer or polysiloxane, fluorosilicone polymer, polyethylene, polypropylene, or a combination thereof. Preferably, the absorbing material is selected from the group consisting of cross-linked silicone polymers and fluorosilicone polymers. The layer is preferably porous at the surface to enable some absorption or flow of liquid into the surface as opposed to only surface adhesion or adsorption.

The absorbent layer should meet the requirements set forth above in other constructions.

The apparatus may provide sheet handling systems that move the drying sheet from a storage or supply area to position the drying sheet into contact with a surface of an intermediate transfer member where the sheet will be able to contact carrier liquid. The absorbent layer of the sheet may have a surface energy that is at least 1 dyne/cm less than the surface energy of the surface it is positioned to contact and to dry.

It is possible that the absorbent may have sufficient retention properties that the absorbent layer is a non-leaching absorbent. This means that the absorbent layer retains the carrier liquid with sufficient strength that ambient moisture and water in landfills will not remove solvent in an amount that would be prohibited by regulatory provisions. An example of a standard for absorption is where a non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C. and 40% relative humidity.

Alternatively, the absorbent layer may be capable of absorbing carrier liquid from a photoreceptor surface and subsequently desorbing the carrier liquid upon application of heat or pressure.

Once a liquid toner developed image has been transferred to an intermediate transfer member or final substrate (not shown), a non-saturated drying sheet is selected and readied (positioned for feeding into the system) in the cartridge 64. The optional inclusion of a feeder roller 62 can help. The non-saturated drying sheet (not shown) may then be applied to the surface of the intermediate transfer member (which faces supply roller 60), passing together with the intermediate transfer member 14 through the nip 68. The imaging apparatus of this invention should provide a drying sheet is capable of absorbing 2%–70% of its own weight in carrier liquid (e.g., 2–70% liquid carrier/98%–30% absorbent sheet). The surfaces remain in contact until after passing through nip 68 formed by rollers 60, 66. After passing through nip 68 the drying sheet, which has now been used, is stored for re-use, recycling, or discard in container or cartridge 64. (If the sheet is coated with absorbent layers on both sides, one skilled in the art would know to store the sheet inverted so that the unused side is placed to contact the intermediate transfer member.) Contact time and choice of absorbent material will determine final dryness or moisture of the intermediate transfer member 14. Whether or not a regeneration means is used for the drying sheets or pads (not shown, but general means for regenerating sheets containing volatile liquids are known in the art), when the life of the sheets in the original cartridge 64 is exhausted, they can be simply exchanged for a new cartridge without calling service personnel.

Figure 4:
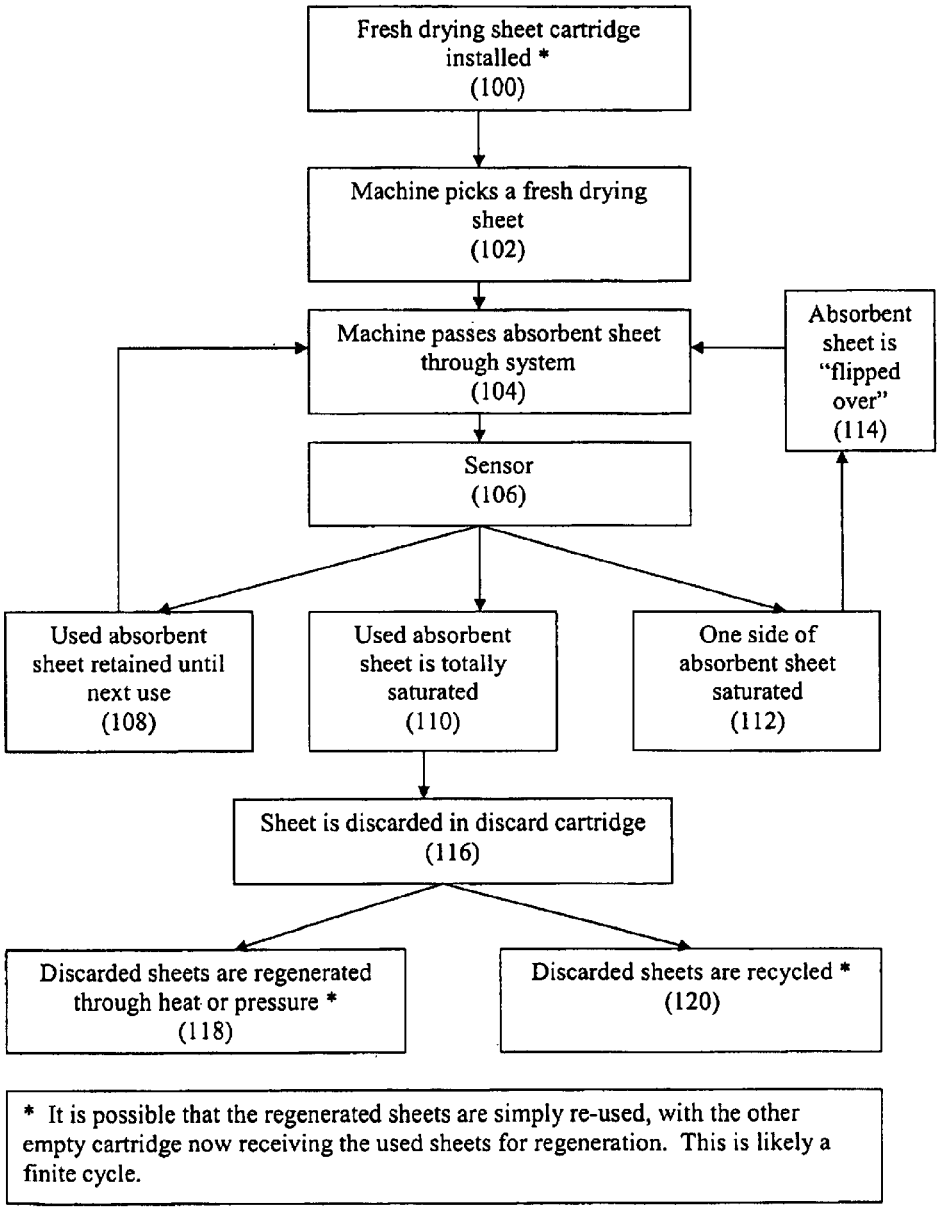
FIG. 4 is a flow chart depicting steps in an embodiment of a method according to the invention.

FIG. 4 is a flow chart, depicting the process steps and method of using a drying sheet in an electrophotographic apparatus. The process is started when a fresh or regenerated drying sheet cartridge or spool is placed in the machine, indicated by the element 100. The machine then selects a sheet (or advances the supply spool) 102 and contacts it to the system element that needs drying (the photoreceptor or the liquid toned latent image on the photoreceptor) 104. A sensing means 106 can be used to determine saturation of the sheet or the number of uses each sheet has undergone. The used sheet can be retained for future uses on the same side 108, 104; found to be substantially saturated on one side 112 and inverted and re-used 114, 104; or found to be substantially saturated 110 and discarded 116. Depending on the use and sophistication of sensors, a sheet maybe used one or more times on one or more sides. The discarded sheets or spools can be recycled or landfilled when no longer suitable for use 120. Alternatively, the discarded sheets or spool may be regenerated through heat or pressure 118. Regenerated sheets may be re-used 100.

Figure 5:
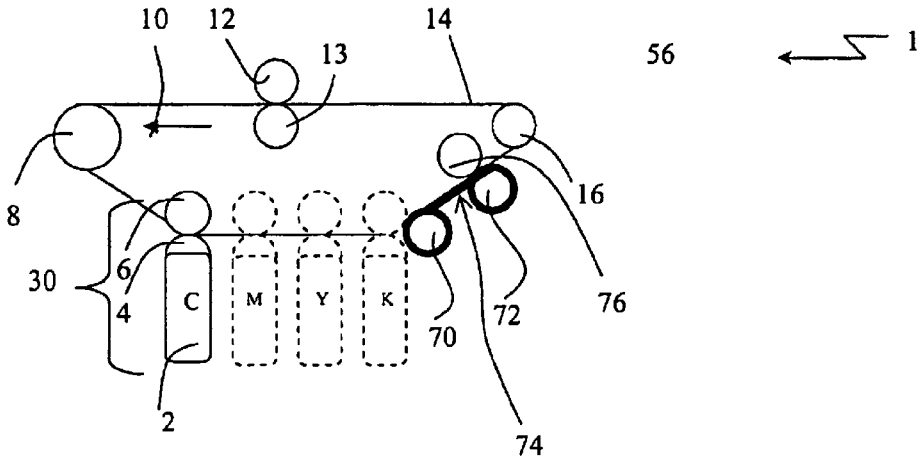
FIG. 5 shows one embodiment of an electrophotographic apparatus using a rolling sheet to dry an image or an intermediate transfer member.

FIG. 5 is a side view of one embodiment of a printing apparatus 1 using one embodiment of the claimed method. The apparatus 1 shown comprises at least one image development station 30 comprised of a toner cartridge 2 which might contain a developer (not shown) for electrostatically plating ink solids from liquid carrier to a photoreceptor drum 4 or belt (not shown), and a backup roller 6 to create a nip. A monochrome printer may have as few as one development station 30, but a multi-color printer will have a plurality of image development stations (shown in FIG. 5 with dashed lines). A toned image is generated on a photoreceptor 4 (method not described) and, in this embodiment, is transferred to an intermediate transfer member 14 (shown here in this non-limiting figure as a belt). The generation of this toned image is the source of the carrier liquid on the intermediate transfer member. The excess liquid carrier may remain on the intermediate transfer member surface 14 after the toned but not fused or permanently adhered liquid toner image is transferred to another intermediate surface or to the final image receiving surface (not shown). The intermediate transfer member 14 may also pick up excess carrier from simply passing through one or more development stations 30. The intermediate transfer belt 14 may be supported and tensioned by rollers 8, 16. The photoreceptor moves in a direction indicated by arrow 10 through each image development station 30, receiving toned images. The final destination of the composite toned image is shown here between rollers 12, 13 where it is transferred to the final substrate (not shown). The transfer step can be accomplished using adhesive transfer or electrostatic transfer methods, or a combination of both. As can be seen from FIG. 5, nearly all rollers in the electrophotographic printer require a backup roller when contacting a belt because of a need for nip pressure. When, for example, an intermediate transfer drum is used, the drum itself becomes the back pressure needed to form the nip. The inclusion, therefore, of roller 76 in FIG. 5 is to form a nip with a drying sheet discard spool 72.

Supply spool or reel 70 holds a continuous non-saturated absorbent drying sheet shown contacting the intermediate transfer member at 74 (although the actual duration of the contact or length of the nip will vary). The continuous drying sheet may be present as a flexible substrate having a first surface and second surface and at least one oleophilic carrier liquid absorptive layer on the first surface of the flexible substrate. The first surface of the flexible substrate faces the intermediate transfer member surface when it is placed in position to absorb liquid carrier. The absorbent sheet may be provided from a supply spool or reel 70 as a continuous sheet wound on a supply roll 70 and taken up on a discard roll or spool 72. The first surface and second surface both may have an oleophilic absorptive layer affixed to each of the first surface and the second surface. This would enable both sides of the substrate to be utilized. The absorbent sheet may have a compliant inner layer affixed between the flexible substrate and the at least one oleophilic carrier liquid absorptive layer. The inner layer may be oleophobic to carrier liquid and may be at least less oleophilic then the absorbent layer. The inner layer typically comprises a polymer selected from nitrile elastomers, fluorosilicone polymers, fluorocarbon polymers, and polyurethane polymers.

The substrate of the absorbent sheet may be opaque or substantially transparent and may comprise one or more layers of appropriately selected materials. The substrate may be constructed of or comprise any suitable components giving the desired properties as described herein. Non-limiting examples of suitable materials for the substrate are polyester such as polyethylene terephthalate and polyethylene naphthalate, polyimide, polysulfone, cellulose triacetate, polyamide, polyolefins, polycarbonate, vinyl resins such as polyvinyl chloride, polyvinylbutyral and polystyrene, and the like. Specific examples of supporting substrates included polyethersulfone (Stabar® S-100 polymer, commercially available from ICI), polyvinyl fluoride (Tedlar® polymer, commercially available from E.I. DuPont de Nemours & Company), polybisphenol-A polycarbonate (Makrofol® film, commercially available from Mobay Chemical Company) and amorphous polyethylene terephthalate (Melinar®, commercially available from ICI Americas, Inc. and Dupont A and Dupont 442, commercially available from E.I. DuPont de Nemours & Company).

The desired thickness of the substrate of the absorbing member depends on a number of factors, including economic considerations. The substrate typically is between 10 microns and 1000 microns thick, preferably between 25 microns and 250 microns. When the absorbent sheet is used in a liquid electrophotographic imaging member, the thickness of the substrate should be selected to avoid any adverse affects on the final device and process. The substrate should not be so thin that it splits, wrinkles and/or exhibits poor durability characteristics. The substrate likewise should not be so thick that it may give rise to early failure during cycling, a lower flexibility, and a higher cost for unnecessary material.

The absorbent material in the absorbent layer of the at least one layer absorbing member should be mechanically durable and have a high affinity to the carrier fluids, e.g. hydrocarbons, in the liquid inks. Non-limiting examples of suitable absorbent material are silicone polymer or polysiloxane, fluorosilicone polymer, polyethylene, polypropylene, or a combination thereof. Preferably, the absorbing material is selected from the group consisting of cross-linked silicone polymers and fluorosilicone polymers. The layer is preferably porous at the surface to enable some absorption or flow of liquid into the surface as opposed to only surface adhesion or adsorption.

The absorbent layer should meet the qualifications described above in other constructions.

The apparatus may provide sheet handling systems that move the drying sheet from a storage or supply area to position the drying sheet into contact with a surface of an intermediate transfer member where the sheet will be able to contact carrier liquid. The absorbent layer of the sheet may have a surface energy that is at least 1 dyne/cm less than the surface energy of the surface it is positioned to contact and to dry.

It is possible that the absorbent may have sufficient retention properties that the absorbent layer is a non-leaching absorbent. This means that the absorbent layer retains the carrier liquid with sufficient strength that ambient moisture and water in landfills will not remove solvent in an amount that would be prohibited by regulatory provisions. An example of a standard for absorption is where a non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C. and 40% relative humidity.

Alternatively, the absorbent layer may be capable of absorbing carrier liquid from an intermediate transfer member surface and subsequently desorbing the carrier liquid upon application of heat or pressure.

The supply and discard roller system may be used to dry either the liquid toner developed image, as shown in FIG. 5, or to dry an intermediate transfer member after the toned image has been transferred away (not shown). In either case, the supply roller 70 advances a length of the drying sheet as the intermediate transfer member moves (as indicated by arrow 10). Simultaneously, the discard spool or roller 72 takes up the used length. The duration of contact (shown here as 74) will vary based on the dimensions of the machine, the absorbent efficiency and the desired dryness. The non-saturated drying sheet is applied to the surface of the intermediate transfer member (facing the intermediate transfer member 14), passing together with the intermediate transfer member 14 until it reaches and is taken up by the discard roller or reel 72. The imaging apparatus of this invention should provide a drying sheet is capable of absorbing 2%–70% of its own weight in carrier liquid (e.g., 2–70% liquid carrier/98%–30% absorbent sheet). The surfaces remain in contact until after passing through a nip which may be formed by rollers 72 and 76. After contacting the intermediate transfer member, the drying sheet, which has now been used, is stored for re-use, recycling, or discard on discard roller 72. (If the sheet is coated with absorbent layers on both sides, one skilled in the art would know to interchange the rollers so that the unused side is placed in contact with the intermediate transfer member). Contact time and choice of absorbent material will determine final dryness or moisture of the intermediate transfer member 14. Whether or not a regeneration means is used for the continuous drying sheet (not shown, but general means for regenerating sheets containing volatile liquids are known in the art), when the life of the sheets in the original supply roller 70 is exhausted, they can be simply exchanged for a new cartridge without calling service personnel. The placement of the drying supply and discard rollers in FIG. 5 is for illustrative purposes only and is not meant to limit placement of the drying device.

What is claimed:

1. A liquid electrophotographic imaging apparatus containing at least one drying sheet for removing excess carrier liquid in a liquid toner toned latent image on an intermediate transfer member surface or from the intermediate transfer member surface itself, the at least one drying sheet comprising, a flexible substrate having a first surface and second surface;

at least one oleophilic carrier liquid absorptive layer on the first surface of the flexible substrate, wherein the at least one oleophilic carrier absorptive layer comprises a polymer selected from the group consisting of silicone polymers and fluorosilicones; and the first surface of the flexible substrate facing said intermediate transfer member surface having thereon an electrophotographic image.

2. The imaging apparatus of claim 1 wherein a compliant inner layer is affixed between the flexible substrate and the at least one oleophilic carrier liquid absorptive layer.

3. The imaging apparatus of claim 2 wherein the inner layer is oleophobic to carrier liquid.

4. The imaging apparatus of claim 2 wherein the inner layer comprises a fluorocarbon polymers.

5. The imaging apparatus of claim 2 wherein the at least one absorbent layer comprises a polymer selected from silicones, ethylene/propylene copolymers, polybutadienes, and polyisoprenes.

6. The imaging apparatus of claim 2 wherein systems moving the drying sheet position the drying sheet into contact with a surface of an intermediate transfer member to contact carrier liquid during an electrophotographic imaging process for the purpose of drying liquid carrier and wherein absorbent layer of the sheet has a surface energy that is at least 1 dyne/cm less than the surface energy of the surface it is positioned to contact and to dry.

7. The imaging apparatus of claim 2 wherein the drying sheet is capable of absorbing 2%–70% of its own weight in carrier liquid.

8. The imaging apparatus of claim 2 wherein the absorbent layer is a non-leaching absorbent which retains the carrier liquid with sufficient strength that ambient moisture and water in landfills will not remove solvent in an amount that would be prohibited by regulatory provisions.

9. The imaging apparatus of claim 8 wherein the non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C.

10. The imaging apparatus of claim 2 wherein the absorbent layer is capable of absorbing carrier liquid from an image and subsequently desorbing the carrier liquid either singly or in a cartridge upon application of heat or pressure.

11. The imaging apparatus of claim 1 wherein the at least one absorbent layer comprises a polymer selected from the group consisting of silicone polymers, ethylene/propylene copolymers, polybutadienes, and polyisoprenes.

12. The imaging apparatus of claim 1 wherein systems moving the drying sheet position the drying sheet into contact with a surface of an intermediate transfer member to contact carrier liquid during an electrophotographic imaging process for the purpose of drying liquid carrier and wherein absorbent layer of the sheet has a surface energy that is at least 1 dyne/cm less than the surface energy of the surface it is positioned to contact and to dry.

13. The imaging apparatus of claim 1 wherein the drying sheet is capable of absorbing 2%–70% of its own weight in carrier liquid.

14. The imaging apparatus of claim 1 wherein the absorbent layer is a non-leaching absorbent which retains the carrier liquid with sufficient strength that ambient moisture and water in landfills will not remove solvent in an amount that would be prohibited by regulatory provisions.

15. The imaging apparatus of claim 14 wherein the non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C.

16. The imaging apparatus of claim 1 wherein the absorbent layer is capable of absorbing carrier liquid from an image and subsequently desorbing the carrier liquid either singly or in a cartridge upon application of heat or pressure.

17. A liquid electrophotographic imaging apparatus containing at least one drying sheet for removing excess carrier liquid in a liquid toner toned latent image on an intermediate transfer member surface or from the intermediate transfer member surface itself, the at least one drying sheet comprising;

a flexible substrate having a first surface and second surface;

at least one oleophilic carrier liquid absorptive layer on the first surface of the flexible substrate, and the first surface of the flexible substrate facing said intermediate transfer member surface having thereon an electrophotographic image, wherein said first surface and said second surface have an oleophilic absorptive layer affixed to each of the first surface and the second surface.

18. An electrophotographic imaging apparatus having the ability to remove excess liquid carrier from an intermediate transfer member surface, the electrophotographic imaging apparatus comprising:

an electrophotographic imaging system capable of providing an electrophotographic image on an intermediate transfer member;

an absorbent image drying sheet which contacts the intermediate transfer member, the image drying sheet having at least an outer layer which absorbs carrier liquid, the surface of the drying sheet in contact with the intermediate transfer member having a Shore A hardness of 10 to 60;

wherein the drying sheet after contacting the intermediate transfer member absorbs carrier liquid from a surface of the intermediate transfer member and the drying sheet then becomes a used drying sheet;

a disbursing cartridge for supplying non-saturated drying sheets for use; and a receiving cartridge for receiving used drying sheets.

19. The apparatus of claim 18 wherein the supply cartridge and the disbursing cartridge are within a single housing.

20. The apparatus of claim 18 further comprising a heating element for evaporating carrier liquid from used drying sheets.

21. The apparatus of claim 18 further comprising a pressure element for squeezing carrier liquid from used drying sheets.

22. A method of drying a toner image or an intermediate transfer member comprising the steps of:

providing at least one absorbent drying sheet;

providing an electrophotographic apparatus comprising at least an intermediate transfer member at least one supply container and at least one discard container for the at least one absorbent drying sheet;

providing a toned image on the intermediate transfer member with a liquid toner;

contacting an absorbent drying sheet from the supply container to the toned image on the intermediate transfer member or to the intermediate transfer member itself after the image is transferred away;

absorbing liquid carrier with the drying sheet, the drying sheet then becoming a used drying sheet;

determining whether the used drying sheet is suitable for reuse as an absorbent drying sheet; and placing the used drying sheet in a container selected from the group consisting of: supply container, re-supply container, regeneration container, or discard container depending upon the used drying sheet's determination of suitability of use.

23. The method of claim 22 using a regeneration container wherein heat is applied to the used drying sheets causing at least a portion of the absorbed carrier to be expelled from the substantially saturated drying sheets thereby converting substantially saturated drying sheets to non-saturated drying sheets.

24. The method of claim 22 using a regeneration container wherein pressure is applied to the used drying sheets causing at least a portion of the absorbed carrier to be expelled from the substantially saturated drying sheets thereby converting substantially saturated drying sheets to non-saturated drying sheets.

25. The method of claim 22 using a discard container wherein the container of used drying sheets is recycled.

26. The method of claim 22 using a discard container wherein the container of used drying sheets meets regulatory requirements of non-leachability and is disposed of in a landfill.

27. A method of removing carrier liquid a) from a liquid toner image on an intermediate transfer member or b) from an intermediate transfer member after transfer of a liquid toner image to a final substrate comprising the steps of:

providing a plurality of absorbent drying sheets in a cartridge, wherein the sheets are stacked such that there is a top of the stack and a bottom of the stack;

providing an electrophotographic apparatus comprising at least an intermediate transfer member a cartridge of drying sheets;

providing a toned image on the intermediate transfer member;

contacting an absorbent drying sheet from the cartridge to the toned image on the intermediate transfer member, or to the intermediate transfer member itself after the image is transferred away, the drying sheet on absorbing liquid carrier becoming a used drying sheet;

replacing the used drying sheet at the top of the stack in the absorbent drying sheet cartridge for re-supply or discard.

28. The method of claim 27 wherein the absorbent drying sheet is non-leaching with respect to the carrier liquid further comprising the step of removing the cartridge filled with used drying sheets for disposal in a landfill.

* * * * *